US008491335B2

(12) United States Patent
Matsumoto et al.

(10) Patent No.: US 8,491,335 B2
(45) Date of Patent: Jul. 23, 2013

(54) WATERPROOF CONNECTOR

(75) Inventors: Mitsuhiro Matsumoto, Makinohara (JP); Hajime Kato, Makinohara (JP); Yoshiaki Ozaki, Makinohara (JP); Tsuyoshi Mizushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/259,881

(22) PCT Filed: Mar. 23, 2010

(86) PCT No.: PCT/JP2010/055009
§ 371 (c)(1),
(2), (4) Date: Sep. 23, 2011

(87) PCT Pub. No.: WO2010/110278
PCT Pub. Date: Sep. 30, 2010

(65) Prior Publication Data

US 2012/0021632 A1 Jan. 26, 2012

(30) Foreign Application Priority Data

Mar. 24, 2009 (JP) ..... P2009-071752

(51) Int. Cl.
*H01R 13/52* (2006.01)

(52) U.S. Cl.
USPC ..... 439/587

(58) Field of Classification Search
USPC ..... 439/587, 271–275
See application file for complete search history.

(56) References Cited

U.S. PATENT DOCUMENTS 5,098,315 A * 3/1992 Scowen ..... 439/587
5,580,264 A 12/1996 Aoyama et al.

(Continued)

FOREIGN PATENT DOCUMENTS

JP 08-064297 3/1996
JP 2001-060475 3/2001

OTHER PUBLICATIONS

International Search Report from the Japanese Patent Office for International Application No. PCT/JP2010/055009, mailing date Apr. 27, 2010.

*Primary Examiner* — Briggitte R Hammond
(74) *Attorney, Agent, or Firm* — Finnegan, Henderson, Farabow, Garrett & Dunner, L.L.P.

(57) ABSTRACT

There is provided a waterproof connector in which swing of electric wires inside a rear holder can be prevented, and insertion of the rear holder into a connector body can be easily performed with a small force. The waterproof connector includes a connector body 2 having a terminal containing room 21 in which a terminal metal fitting 9 of an electric wire 7 is contained, a waterproof plug 3 which is fitted to the electric wire 7 at a wire withdrawing side 23 of the connector body 2 and assembled to the wire withdrawing side 23 of the connector body 2, and a rear holder 5 which is mounted on the wire withdrawing side 23 of the connector body 2 thereby to prevent drop of the waterproof plug 3 from the connector body 2. The rear holder includes a pair of half bodies which are separated as a first holder body 51 and a second holder body 52, wire containing recesses 53, 54 which contain respective semi-circular portions of the electric wire are respectively formed in the first holder body 51 and the second holder body 52, and the first holder body 51 and the second holder body 52 are individually mounted on the wire withdrawing side 23 of the connector body 2 to be combined together.

11 Claims, 7 Drawing Sheets

U.S. PATENT DOCUMENTS 6,331,124 B1 12/2001 Miyazaki et al.
6,443,766 B2 * 9/2002 Ichio et al. ..... 439/587
6,814,617 B2 * 11/2004 Oota et al. ..... 439/589
7,344,408 B2 * 3/2008 Kato et al. ..... 439/578
7,682,205 B2 * 3/2010 Hall et al. ..... 439/752
2009/0197450 A1 * 8/2009 Ooki et al. ..... 439/271

* cited by examiner

WATERPROOF CONNECTOR

TECHNICAL FIELD

The present invention relates to a waterproof connector which is used in an automobile or the like.

BACKGROUND ART

A waterproof connector includes a connector body for containing terminal metal fittings which are connected to electric wires, a waterproof plug which is assembled to a wire withdrawing side of the connector body in a state where the electric wires are passed through the waterproof plug, and a rear holder which is mounted on the wire withdrawing side of the connector body so as to be positioned in rear of the waterproof plug in a state where the electric wires are passed through the rear holder, thereby to prevent drop of the waterproof plug. The rear holder is provided with recesses into which the electric wires are inserted, in a manner respectively corresponding to the electric wires.

In a conventional waterproof connector, the rear holder is formed including a pair of half bodies in which the electric wire inserting recesses are respectively formed so as to be opposed to each other, and a hinge part for coupling a pair of the half bodies at their one end side in a longitudinal direction thereof (Reference should be made to Patent Document 1, for example). This rear holder is mounted on the connector body, by inserting it along a longitudinal direction of the electric wires from the rear of the waterproof plug, in a state where the half bodies are combined together so as to clamp the electric wires.

<Prior Art Document>

<Patent Document>

Patent Document 1: JP-A-2001-60475

SUMMARY OF THE INVENTION

Problems that the Invention is to Solve

In the conventional waterproof connector, in case where there is a clearance between inner peripheries of the recesses of the rear holder and outer peripheries of the electric wires, the connector body vibrates, and the electric wires are swung inside the rear holder. Therefore, there is such a problem that the electric wires may be broken. In case where the clearance between the inner peripheries of the recesses of the rear holder and the outer peripheries of the electric wires is reduced for avoiding such phenomenon, a frictional force between the rear holder and the electric wires is increased, and hence, an inserting force for inserting the rear holder into the connector body is increased. Therefore, there occurs such a problem that assembling workability is deteriorated.

In view of the above, it is an object of the invention to provide a waterproof connector in which swing of electric wires inside a rear holder can be prevented, and insertion of the rear holder into a connector body can be easily performed with a small force.

Means for Solving the Problems

According to the invention, there is provided a waterproof connector comprising a connector body having a terminal containing room in which a terminal metal fitting of an electric wire is contained, a waterproof plug which is fitted to the electric wire at a wire withdrawing side of the connector body and assembled to the wire withdrawing side of the connector body, and a rear holder which is mounted on the wire withdrawing side of the connector body thereby to prevent drop of the waterproof plug from the connector body, wherein the rear holder includes a first holder body and a second holder body, wire containing recesses for containing the electric wire are respectively formed in the first holder body and the second holder body, and the first holder body and the second holder body are individually mounted on the wire withdrawing side of the connector body thereby to be combined together.

Preferably, either one of the first holder body and the second holder body is provided with a locking projection, and the other is provided with a locking recess which is adapted to be engaged with the locking projection, when the first and second holder bodies are mounted on the wire withdrawing side of the connector body.

Preferably, the locking projection includes an upright insertion wall to be inserted into the locking recess, and a pressing wall which is provided at a tip end of the upright insertion wall and presses one of the first holder body and the second holder body against the other.

Preferably, either one of the first holder body and the second holder body which is mounted on the wire withdrawing side of the connector body later is provided with a draw-in chamfered part which comes into contact with an opening at the wire withdrawing side of the connector body thereby to guide insertion on the relevant holder body.

Preferably, a plurality of locking protuberances are formed on an outer peripheral face of the connector body, and locking arms to be engaged with the locking protuberances are formed on the first holder body or the second holder body.

Advantage of the Invention

According to the above described structure, the first holder body and the second holder body which are separated are individually mounted on the connector body in a state where the electric wire is contained in the wire containing recesses, and combined together thereby to form the rear holder. Because the first holder body and the second holder body are individually mounted on the connector body in this manner, even though an inner diameter of the wire containing recesses is set to be smaller than an outer diameter of the electric wire for the purpose of making a clearance between inner peripheries of the wire containing recesses and an outer periphery of the electric wire small, inserting forces for inserting the respective holder bodies into the connector body will not be increased, and assembling work is facilitated. Moreover, because the clearance between the inner peripheries of the wire containing recesses and the outer periphery of the electric wire can be made small, the electric wire will not be swung inside the rear holder with vibration or so, and break of the electric wire can be prevented. As the results, reliability of electrical connection is enhanced.

According to the above described structure, when the locking projection of one of the holder bodies and the locking recess of the other holder body are engaged with each other, the two holder bodies which are separated are assembled to be combined together thereby to function as the rear holder. Accordingly, the rear holder can be easily and reliably assembled.

According to the above described structure, when the upright insertion wall which is formed on the locking projection of one of the holder bodies is inserted into the locking recess of the other holder body, the pressing wall presses the one of the holder bodies against the other. Therefore, the first holder body and the second holder body will not be opened, but can reliably function as the rear holder.

According to the above described structure, because the draw-in chamfered part is formed on the holder body which is mounted on the connector body later, the holder body can be easily inserted into the connector body, and therefore, it becomes easy to assemble the holder bodies to the connector body.

According to the above described structure, when the locking arms which are formed on the first holder body or the second holder body are engaged with the locking protuberances of the connector body, drop of the rear holder from the connector body can be prevented, and stable mounting can be made.

MODE FOR CARRYING OUT THE INVENTION

Figure 1:
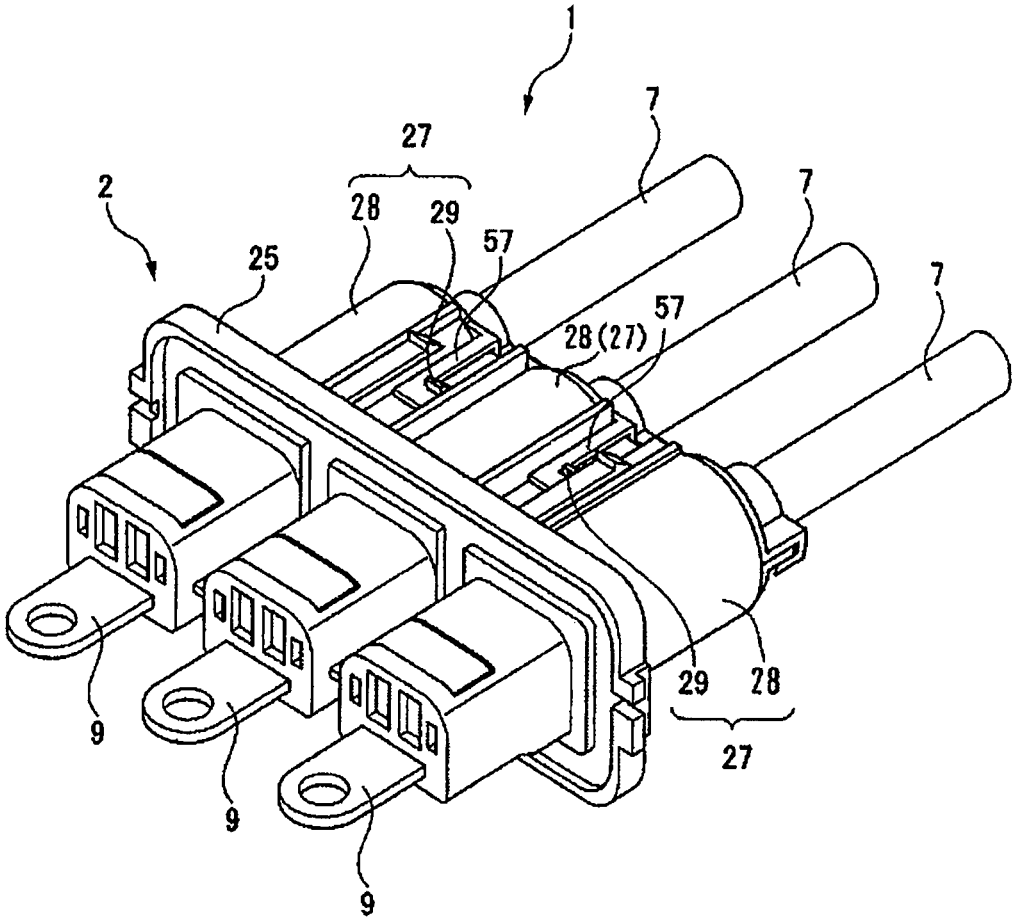
FIG. 1 is a perspective view showing a waterproof connector in an embodiment according to the invention.

Now, a waterproof connector in an embodiment according to the invention will be described referring to the drawings.

Figure 2:
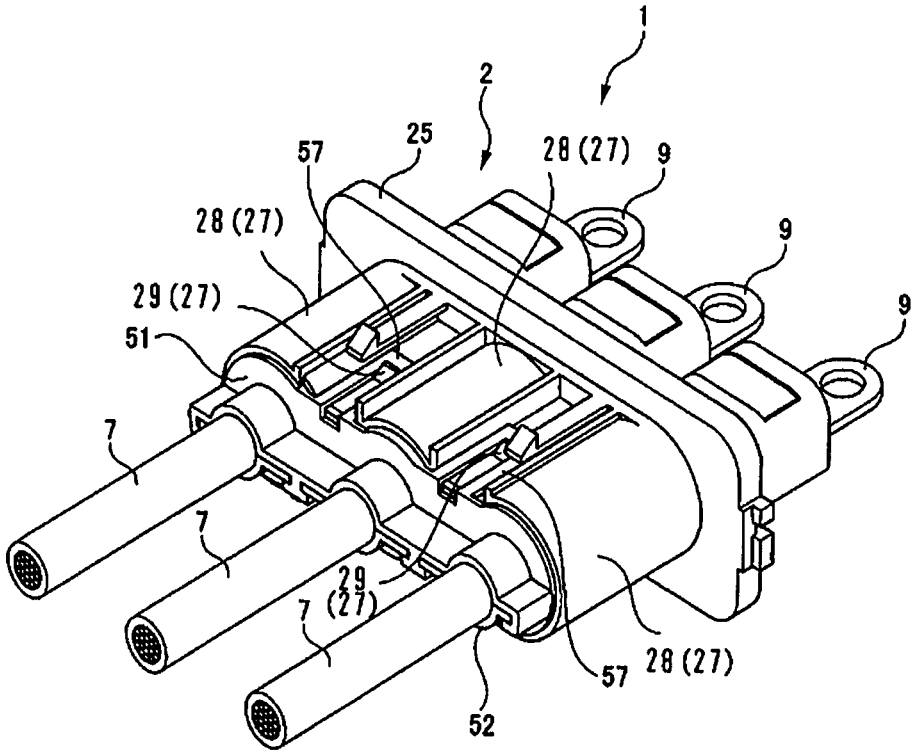
FIG. 2 is a perspective view as seen from an opposite side to a side in FIG. 1.
Figure 3:
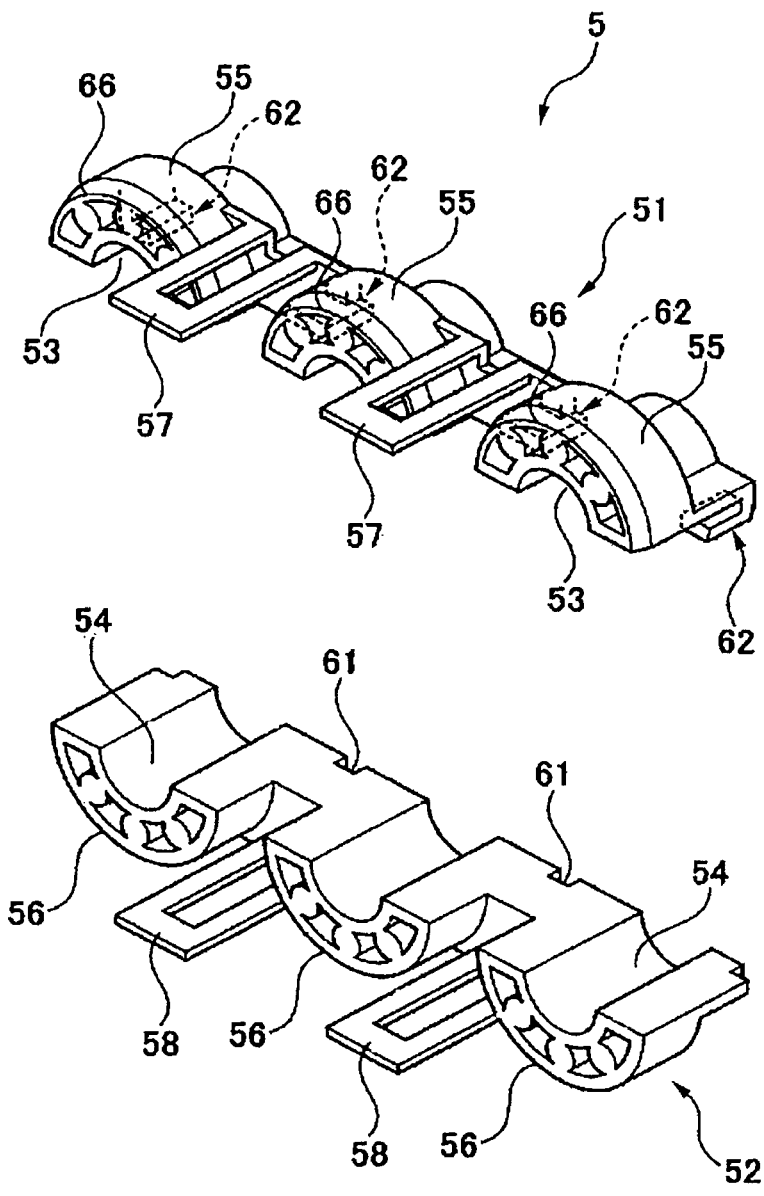
FIG. 3 is an exploded perspective view showing a rear holder.
Figure 4:
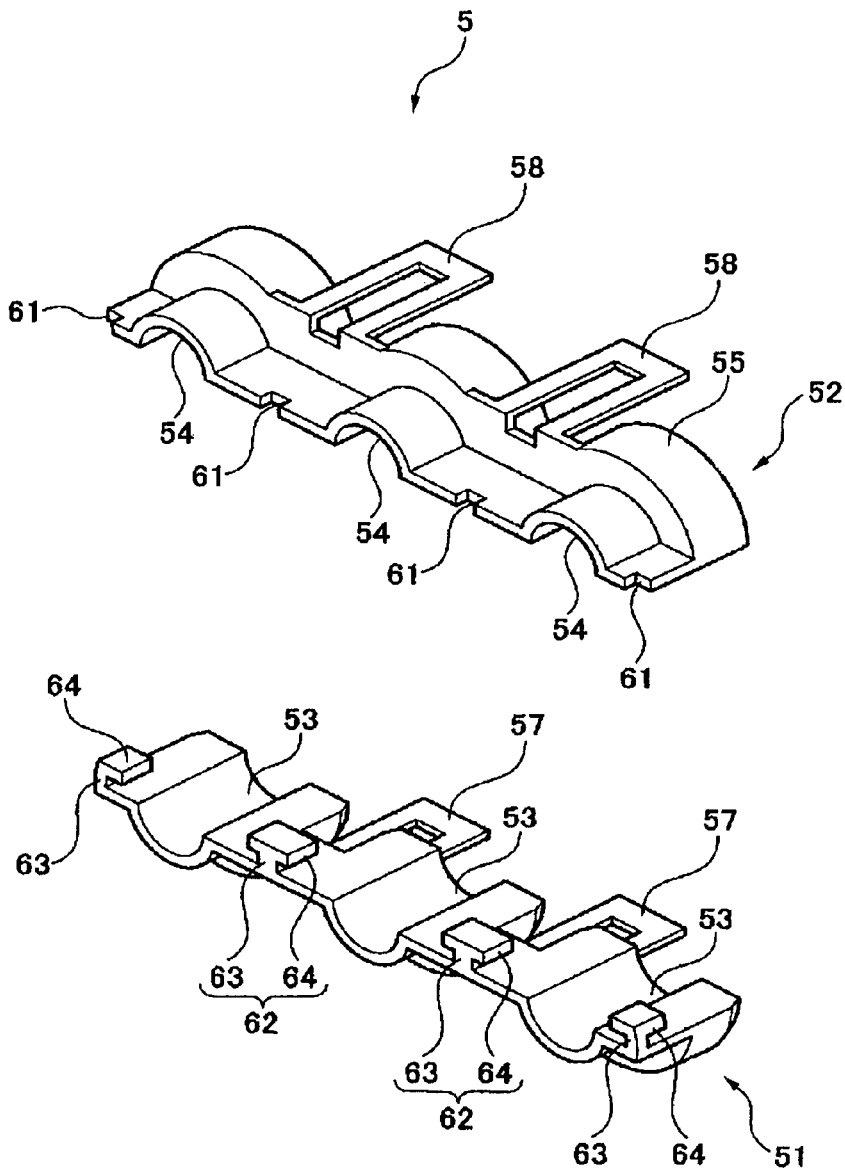
FIG. 4 is an exploded perspective view as seen from an opposite side to a side in FIG. 3.
Figure 5:
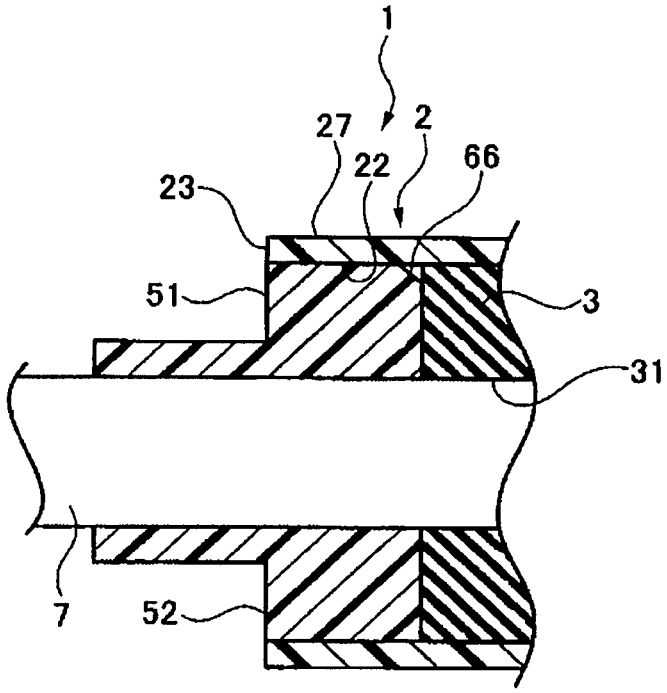
FIG. 5 is a sectional view showing a state where the rear holder is mounted on a connector body.

FIG. 1 is a perspective view of a waterproof connector 1 in an embodiment according to the invention, FIG. 2 is a perspective view as seen from an opposite side to a side in FIG. 1, FIG. 3 is an exploded perspective view of a rear holder 5, FIG. 4 is an exploded perspective view of the rear holder 5 as seen from an opposite side to a side in FIG. 3, FIG. 5 is a sectional view showing a state where the rear holder 5 is mounted on a connector body 2, and FIGS. 6 to 9 are sectional views showing steps for mounting the rear holder 5 on the connector body 2.

As shown in FIGS. 1 and 2, the waterproof connector 1 includes the connector body 2, a waterproof plug 3 (See FIG. 5), and the rear holder 5. Electric wires 7 are fitted to the waterproof connector 1 in a state where terminal metal fittings 9 are attached to terminal ends of the electric wires.

The connector body 2 is formed of insulating resin, and a terminal containing room 21 and a waterproof plug containing room 22 are formed inside the connector body 2 so as to communicate with each other, as shown in FIGS. 6 to 9. The waterproof plug containing room 22 is made larger in diameter, and formed at a side 23 where the electric wires are withdrawn.

As shown in FIGS. 1 and 2, the connector body 2 is provided with a flange wall part 25 for enabling the connector body 2 to be assembled to a mating connector (not shown). A tubular wall part 27 is formed at the wire withdrawing side 23 of the flange wall part 25. The tubular wall part 27 has tubular body parts 28, the number of which corresponds to the number of the electric wires 7 to be fitted. Moreover, locking protuberances 29 are formed on the tubular wall part 27. The locking protuberances 29 are formed on an outer peripheral face of the tubular wall part 27 at positions between the respective tubular body parts 28, and locked on the rear holder 5, as described below.

The waterproof plug 3 is formed of insulating rubber material, and adapted to be inserted into the waterproof plug containing room 22 at the wire withdrawing side 23 of the connector body 2, as shown in FIG. 5 and FIGS. 7 to 9. As shown in FIG. 5, wire inserting holes 31 into which the electric wires 7 are respectively inserted are formed so as to pass through the waterproof plug 3. Inner walls of the wire inserting holes 31 come into tight contact with the electric wires 7 which have been inserted, and waterproofing of the electric wires 7 is performed with this tight contact.

The rear holder 5 is a member for preventing drop of the waterproof plug 3 from the connector body 2, and formed of insulating resin. The rear holder 5 is inserted into the waterproof plug containing room 22 in the connector body 2 so as to be positioned in rear of the waterproof plug 3, thereby to prevent drop of the waterproof plug 3.

As shown in FIGS. 3 and 4, the rear holder 5 includes a first holder body 51 and a second holder body 52. The first holder body 51 and the second holder body 52 respectively constitute half bodies in a pair which are formed by cutting the rear holder 5 into halves at a horizontal plane, and are separated from each other as independent pieces.

The first holder body 51 and the second holder body 52 respectively have semi-tubular parts 55 and 56 which are formed corresponding to the number of the electric wires 7 so as to be opposed to each other. An outer diameter of the semi-tubular parts 55, 56 is so set that outer peripheries of the semi-tubular parts 55, 56 may come into contact with an inner face of the tubular wall part 27 of the connector body 2.

Electric wire containing recesses 53, 54 for containing respective semi-circular portions of the electric wire 7 are formed on opposed faces of the semi-tubular parts 55, 56. By assembling the first holder body 51 and the second holder body 52 to each other, the electric wire 7 is clamped between the wire containing recesses 53, 54 which are opposed to each other. In this embodiment, it is possible to form an inner diameter of the wire containing recesses 53, 54 so as to be smaller than an outer diameter of the electric wire 7.

The first holder body 51 and the second holder body 52 are respectively provided with locking arms 57, 58. The locking arm 57 is formed between the respective semi-tubular parts 55 of the first holder body 51, and the locking arm 58 is formed between the respective semi-tubular parts 56 of the second holder body 52. Either of the locking arms 57, 58 extends in a plate-like shape from a position between the semi-tubular parts 55, 56 toward an opposite side to the wire withdrawing side 23. The locking arms 57, 58 are adapted to be locked to locking protuberances 29 which are formed on an outer peripheral face of the connector body 2, and with this locking action, the rear holder 5 is assembled to the connector body 2 thereby to be prevented from dropping from the connector body 2. It is to be noted that either one of the locking arms 57, 58 can be omitted. This is because the first holder body 51 and the second holder body 52 are combined together when they are assembled, as described below, and hence, drop of the rear holder 5 can be prevented only by locking either one of the locking arms 57, 58 to the connector body.

In this embodiment, the first holder body 51 is provided with a locking projection 62, and the second holder body 52 is provided with a locking recess 61. As shown in FIG. 4, the locking projection 62 is formed in the first holder body 51 at an opposite side to a side where the locking arm 57 is formed. The locking recess 61 is formed in the second holder body 52 so as to be opposed to the locking projection 62 of the first holder body 51. The locking projection 62 has an upright insertion wall 63 erected from an outer face of the first holder body 51 and a pressing wall 64 which is integrally formed at a tip end side of the upright insertion wall 63. The upright insertion wall 63 is inserted into the locking recess 61 of the second holder body 52. The pressing wall 64 extends in a lateral direction with respect to the upright insertion wall 63, and comes into contact with a periphery of the locking recess 61, when the upright insertion wall is inserted into the locking recess 61. Due to this contact, the pressing wall 64 acts on the first holder body 51 to press it against the second holder body 52.

The first holder body 51 and the second holder body 52 which are separated are individually inserted into the waterproof plug containing room 22 in the connector body 2 from the wire withdrawing side 23. In this embodiment, after the second holder body 52 has been inserted into the waterproof plug containing room 22 in the connector body 2, the first holder body 51 is inserted into the waterproof plug containing room 22. In the first holder body 51 to be inserted into the connector body 2 later, draw-in chamfered parts 66 are formed.

As shown in FIG. 3, each of the draw-in chamfered parts 66 is formed as an inclined face which is formed by cutting a distal end part of the semi-tubular part 55 in the first holder body 51. As shown in FIG. 5, the inclined face of the draw-in chamfered part 66 is inclined so as to be gradually separated from a direction of insertion into the connector body 2. When the first holder body 51 is inserted into the connector body 2, the draw-in s chamfered part 66 comes into contact with an inner face of the waterproof plug containing room 22 of the connector body 2, and guides the insertion of the first holder body 51 with this contact. Therefore, when the first holder body 51 is inserted into the connector body 2 after the insertion of the second holder body 52, an inserting operation can be smoothly performed.

Now, assembling steps of the waterproof connector 1 in this embodiment will be described referring to FIGS. 6 to 9.

Figure 6:
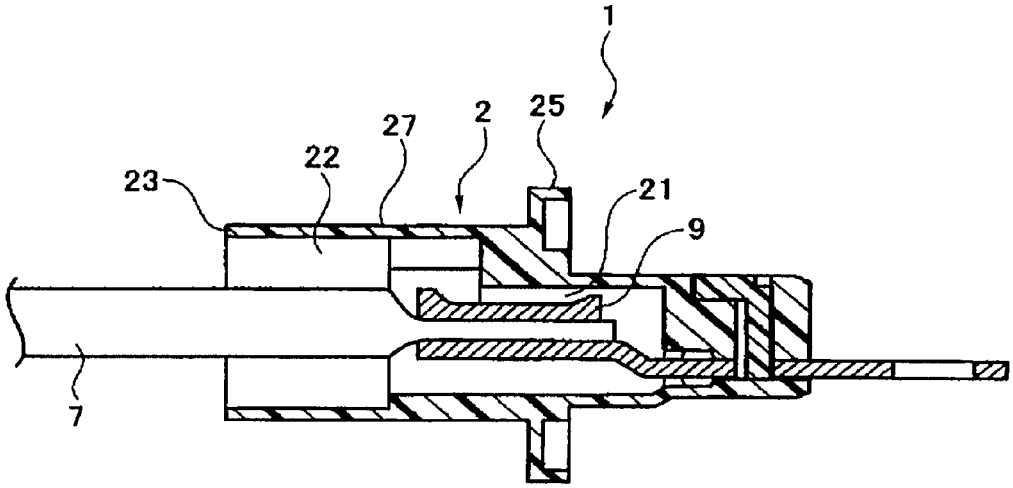
FIG. 6 is a sectional view showing a state where an electric wire is fitted to a connector body.

FIG. 6 shows a state where the electric wire 7 and the terminal metal fitting 9 are contained in each of the terminal containing rooms 21 of the connector body 2, by inserting the terminal metal fitting 9 into the connector body 2.

Figure 7:
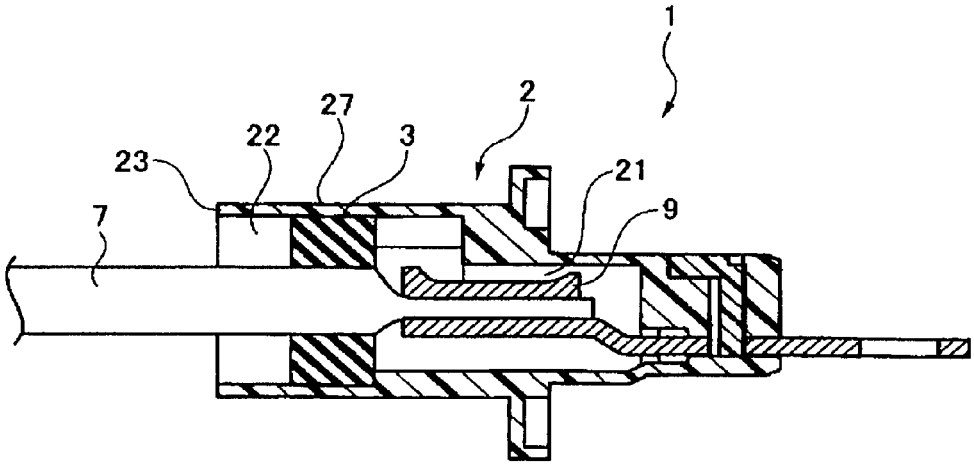
FIG. 7 is a sectional view succeeding to FIG. 6, showing a state where a waterproof plug is mounted on the connector body.

FIG. 7 shows a state where the waterproof plug 3 is mounted, in contrast with the state in FIG. 6. The waterproof plug 3 having the electric wire 7 passed through is moved along the electric wire 7 toward the connector body 2. In this manner, the waterproof plug 3 is inserted into the waterproof plug containing room 22 in the connector body 2 from the wire withdrawing side 23.

Figure 8:
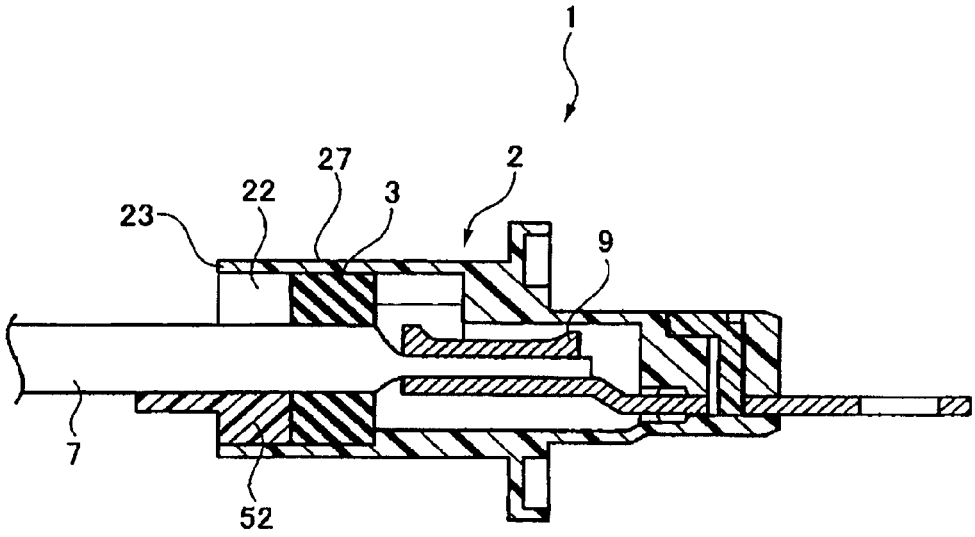
FIG. 8 is a sectional view succeeding to FIG. 7, showing a state where a second holder body is mounted on the connector body.

FIG. 8 shows a state where the second holder body 52 is mounted on the connector body 2, in contrast with the state in FIG. 7. The second holder body 52 is contained in the waterproof plug containing room 22 in the connector body 2 from the wire withdrawing side 23, by moving the second holder body 52 along the electric wire 7 in a state where the lower semi-circular portion of the electric wire 7 is fitted in the wire containing recess 54. In this manner, the second holder body 52 is mounted on the connector body 2. On this occasion, the locking arm 58 is locked to the locking protuberance 29 on the outer periphery of the connector body 2, thereby to prevent the second holder body 52 from dropping from the connector body 2.

Figure 9:
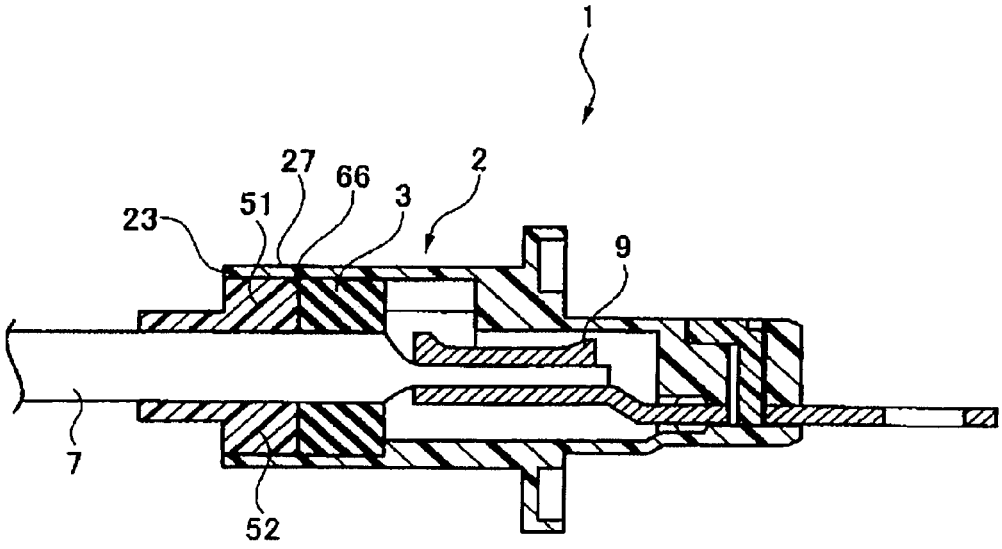
FIG. 9 is a sectional view succeeding to FIG. 8, showing a state where a first holder body is mounted on the connector body.

FIG. 9 shows a state where the first holder body 51 is mounted on the connector body 2, after the second holder 52 has been mounted. The first holder body 51 is contained in the waterproof plug containing room 22 in the connector body 2 from the wire withdrawing side 23, by moving the first holder body 51 along the electric wire 7 in a state where the upper semi-circular portion of the electric wire 7 fitted in the wire containing recess 53. In an initial period when the first holder body 51 is contained from the wire withdrawing side 23, the draw-in chamfered part 66 formed on the semi-tubular part 55 comes into contact with the inner face of the waterproof plug containing room 22 to slide along the inner face, and thus, the insertion into the connector body 2 can be smoothly performed.

The first holder body 51 is inserted with pressure into the connector body 2 in such a manner that the upright insertion wall 63 of the locking projection 62 is inserted into the locking recess 61 of the second holder body 52. When the upright insertion wall 63 is inserted into the locking recess 61, the pressing wall 64 of the locking projection 62 comes into contact with the periphery of the locking recess 61, and with this contact, presses the first holder body 51 against the second holder body 52. In this manner, the first holder body 51 and the second holder body 52 are assembled to be combined together, and the rear holder 5 is assembled. The rear holder 5 is positioned more adjacent to the wire withdrawing side 23 than the waterproof plug 3, and presses the waterproof plug 3 from the rear, thereby to prevent the waterproof plug 3 from dropping from the connector body 2.

By inserting the first holder body 51 into the connector body 2, the locking arm 57 is engaged with the locking protuberance 29 on the outer periphery of the connector body 2. With this engagement, the first holder body 51 is prevented from dropping from the connector body 2.

The above described embodiment has the following advantages.

The first holder body 51 and the second holder body 52 which are separated are individually mounted on the connector body 2 in the state where the semi-circular portions of the electric wire 7 are respectively contained in the wire containing recesses 53, 54, and combined together thereby to form the rear holder 5. Because the first holder body 51 and the second holder body 52 are individually mounted on the connector body 2 in this manner, even though the inner diameter of the wire containing recesses 53, 54 is set to be smaller than the outer diameter of the electric wire 7 to make a clearance between the inner peripheries of the wire containing recesses 53, 54 and the outer periphery of the electric wire 7 small, the inserting forces of the respective holder bodies 51, 52 into the connector body 2 will not be increased, and assembling work is facilitated. Moreover, because the clearance between the inner peripheries of the wire containing recesses 53, 54 and the outer periphery of the electric wire 7 can be made small, the electric wire 7 will not be swung inside the rear holder 5 with vibration or so, and break of the electric wire 7 can be avoided. As the results, reliability of electrical connection is enhanced.

Moreover, when the locking projection 62 of the first holder body 51 and the locking recess 61 of the second holder body 52 are engaged with each other, the two holder bodies 51, 52 in the separated state are assembled to be combined together thereby to function as the rear holder 5. According to this structure, the rear holder 5 can be easily and reliably assembled.

Moreover, when the upright insertion wall 63 which is formed on the locking projection 62 of the first holder body 51 is inserted into the locking recess 61 of the second holder body 52, the pressing wall 64 of the locking projection 62 presses the first holder body 51 against the second holder body 52. Therefore, the first holder body 51 and the second holder body 52 will not be opened, but can reliably function as the rear holder 5.

Moreover, because the draw-in chamfered part 66 is formed on the first holder body 51 which is mounted on the connector body 2 later, the first holder body 51 can be easily inserted into the connector body 2, and hence, it becomes easy to assemble the holder bodies to the connector body 2.

Moreover, when the locking arms 57, 58 which are formed on the first holder body 51 or the second holder body 52 are engaged with the locking protuberances 29 of the connector body 2, drop of the rear holder 5 from the connector body 2 can be prevented, and stable mounting can be made.

Although in the above described embodiment, the locking recess 61 is formed in the second holder body 52, while the locking projection 62 is formed in the first holder body 51, it is possible to form the locking recess 61 in the first holder body 51, and the locking projection 62 in the second holder body 52.

Moreover, in the above described embodiment, the draw-in chamfered part 66 is formed on the first holder body 51. However, in case where the second holder body 52 is mounted on the connector body 2 later than the first holder body 51, the draw-in chamfered part 66 is naturally formed on the second holder body 52.

The invention is based on Japanese Patent Application (Application No. 2009-071752) filed on Mar. 24, 2009, the contents of which are hereby incorporated by reference.

<Description of the Reference Numbers and Signs>

1 Waterproof connector
2 Connector body
3 Waterproof plug
5 Rear holder
7 Electric wire
9 Terminal metal fitting
21 Terminal containing room
23 Wire withdrawing side
29 Locking protuberance
51 First holder body
52 Second holder body
53, 54 Wire containing recess
57, 58 Locking arm
61 Locking recess
63 Upright insertion wall
64 Pressing wall
66 Draw-in chamfered face

The invention claimed is:

1. A waterproof connector, comprising a connector body having a terminal containing room in which a terminal metal fitting of an electric wire is contained, a waterproof plug which is fitted to the electric wire at a wire withdrawing side of the connector body and assembled to the wire withdrawing side of the connector body, and a rear holder which is mounted on the wire withdrawing side of the connector body thereby to prevent the waterproof plug from dropping from the connector body, wherein the rear holder includes a first holder body and a second holder body, wire containing recesses for containing the electric wire are respectively formed in the first holder body and the second holder body, and the first holder body and the second holder body are individually mounted on the wire withdrawing side of the connector body thereby to be combined together, and a plurality of locking protuberances are formed on an outer peripheral face of the connector body, and locking arms to be engaged with the locking protuberances are formed on the first holder body or the second holder body.

2. The waterproof connector as claimed in claim 1, wherein one of the first holder body and the second holder body is provided with a draw-in chamfered part which comes into contact with an opening at the wire withdrawing side of the connector body thereby to guide insertion of the one of the first holder body and the second holder body.

3. The waterproof connector as claimed in claim 1, wherein either one of the first holder body and the second holder body is provided with a locking projection, and the other of the first holder body and the second holder body is provided with a locking recess which is adapted to be engaged with the locking projection, when the first and second holder bodies are mounted on the wire withdrawing side of the connector body.

4. The waterproof connector as claimed in claim 3, wherein the locking projection includes an upright insertion wall to be inserted into the locking recess, and a pressing wall which is provided at a tip end of the upright insertion wall and presses one of the first holder body and the second holder body against the other.

5. The waterproof connector as claimed in claim 1, wherein the waterproof plug is inserted into a waterproof plug containing room in the connector body.

6. The waterproof connecter as claimed in claim 5, wherein the first holder body and the second holder body are individually inserted into the waterproof plug containing room from the wire withdrawing side.

7. A waterproof connector, comprising a connector body having a terminal containing room in which a terminal metal fitting of an electric wire is contained, a waterproof plug which is fitted to the electric wire at a wire withdrawing side of the connector body and assembled to the wire withdrawing side of the connector body, and a rear holder which is mounted on the wire withdrawing side of the connector body thereby to prevent the waterproof plug from dropping from the connector body, wherein the rear holder includes a first holder body and a second holder body, wire containing recesses for containing the electric wire are respectively formed in the first holder body and the second holder body, and the first holder body and the second holder body are individually mounted on the wire withdrawing side of the connector body thereby to be combined together, wherein either one of the first holder body and the second holder body is provided with a locking projection, and the other of the first holder body and the second holder body is provided with a locking recess which is adapted to be engaged with the locking projection, when the first and second holder bodies are mounted on the wire withdrawing side of the connector body, and wherein the locking projection includes an upright insertion wall to be inserted into the locking recess, and a pressing wall which is provided at a tip end of the upright insertion wall and presses one of the first holder body and the second holder body against the other.

8. The waterproof connector as claimed in claim 7, wherein one of the first holder body and the second holder body is provided with a draw-in chamfered part which comes into contact with an opening at the wire withdrawing side of the connector body thereby to guide insertion of the one of the first holder body and the second holder body.

9. The waterproof connector as claimed in claim 7, wherein a plurality of locking protuberances are formed on an outer peripheral face of the connector body, and locking arms to be engaged with the locking protuberances are formed on the first holder body or the second holder body.

10. The waterproof connector as claimed in claim 7, wherein the waterproof plug is inserted into a waterproof plug containing room in the connector body.

11. The waterproof connecter as claimed in claim 6, wherein the first holder body and the second holder body are individually inserted into the waterproof plug containing room from the wire withdrawing side.

* * * * *